US011359349B2

(12) United States Patent
Ohiwa et al.

(10) Patent No.: US 11,359,349 B2
(45) Date of Patent: Jun. 14, 2022

(54) WORK VEHICLE, WORK MANAGEMENT SYSTEM, AND WORK VEHICLE CONTROL METHOD

(71) Applicant: KOMATSU LTD., Tokyo (JP)

(72) Inventors: Kenji Ohiwa, Tokyo (JP); Tomohiro Nakagawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 406 days.

(21) Appl. No.: 16/086,123

(22) PCT Filed: Jun. 19, 2017

(86) PCT No.: PCT/JP2017/022586
§ 371 (c)(1),
(2) Date: Sep. 18, 2018

(87) PCT Pub. No.: WO2017/221904
PCT Pub. Date: Dec. 28, 2017

(65) Prior Publication Data

US 2020/0299929 A1 Sep. 24, 2020

(30) Foreign Application Priority Data

Jun. 21, 2016 (JP) ..... JP2016-122967

(51) Int. Cl.
*E02F 9/12* (2006.01)
*E02F 3/43* (2006.01)
(Continued)

(52) U.S. Cl.
CPC ..... *E02F 9/123* (2013.01); *E02F 3/43* (2013.01); *E02F 9/2029* (2013.01); *E02F 9/265* (2013.01)

(58) Field of Classification Search
CPC . E02F 9/123; E02F 3/43; E02F 9/2029; E02F 9/265
See application file for complete search history.

(56) References Cited

U.S. PATENT DOCUMENTS 9,376,116 B1 * 6/2016 Ge ..... F16F 15/02
9,644,339 B2 * 5/2017 Wada ..... E02F 9/2207
(Continued)

FOREIGN PATENT DOCUMENTS

CN 1497105 A 5/2004
CN 105517645 A 4/2016
(Continued)

OTHER PUBLICATIONS

Annotated JP 59-031323, already of record from the IDS (Year: 1982).*
(Continued)

*Primary Examiner* — James M McPherson
*Assistant Examiner* — Kyle J Kingsland
(74) *Attorney, Agent, or Firm* — Global IP Counselors, LLP

(57) ABSTRACT

A work vehicle includes a traveling unit, a revolving unit disposed on an upper side of the traveling unit, a work implement disposed on the revolving unit, a revolving driver that revolves the revolving unit, a receiver, an end position setting component, a revolution position sensor, and a drive controller. The receiver directly or indirectly receives information related to a position of an object serving as a target of a revolution of the revolving unit, from the object. The end position setting component sets an end position of a revolution of the revolving unit based on information related to the position of the object. The revolution position sensor senses a revolution position of the revolving unit during a revolution. The drive controller controls the revolving driver based on the revolution position to revolve the revolving unit from a start position of a revolution to the end position.

6 Claims, 9 Drawing Sheets

(51) Int. Cl.
*E02F 9/20* (2006.01)
*E02F 9/26* (2006.01)

(56) References Cited

U.S. PATENT DOCUMENTS

| | | | | |
|---|---|---|---|---|
| 2003/0115779 | A1* | 6/2003 | Satzler | E02F 3/439 37/348 |
| 2010/0017074 | A1* | 1/2010 | Verkuilen | E02F 9/265 701/50 |
| 2016/0217398 | A1* | 7/2016 | Unuma | G06Q 50/30 |
| 2016/0244949 | A1 | 8/2016 | Kanemitsu | |
| 2017/0113591 | A1* | 4/2017 | Spielman, Jr. | E02F 1/00 |
| 2017/0114519 | A1* | 4/2017 | Hague | E02F 3/434 |

FOREIGN PATENT DOCUMENTS

| | | | | |
|---|---|---|---|---|
| JP | 59-31323 | A | 2/1984 | |
| JP | 63-75223 | A | 4/1988 | |
| JP | 2000-192514 | A | 7/2000 | |
| JP | 2008-240461 | A | 10/2008 | |
| JP | 2016-89559 | A | 5/2016 | |
| WO | WO-2014162745 | A1 * | 10/2014 | E02F 9/2296 |

OTHER PUBLICATIONS

Annotated English Translation of Mori (JP 63-075223); Mar. 5, 1998 (Year: 1998).*
The Office Action for the corresponding Chinese application No. 201780017629.9, dated Jul. 20, 2020.
The International Search Report for the corresponding international application No. PCT/JP2017/022586, dated Aug. 29, 2017.

* cited by examiner

WORK VEHICLE, WORK MANAGEMENT SYSTEM, AND WORK VEHICLE CONTROL METHOD

CROSS-REFERENCE TO RELATED APPLICATIONS

This application is a U.S. National stage application of International Application No. PCT/JP2017/022586, filed on Jun. 19, 2017. This U.S. National stage application claims priority under 35 U.S.C. § 119(a) to Japanese Patent Application No. 2016-122967, filed in Japan on Jun. 21, 2016, the entire contents of which are hereby incorporated herein by reference.

BACKGROUND

Field of the Invention

The present invention relates to a work vehicle, a work management system, and a control method for a work vehicle.

Background Information

The earth excavated by a work vehicle such as a hydraulic excavator is loaded into and transported by a dumper truck or the like. In the loading of earth, the hydraulic excavator repeatedly needs to revolve from the excavation position to the vessel of the dumper truck. Since this repetitive revolving work is a burden on the operator, automation is preferred (see, for example, JP-A 2000-192514).

With the autonomous construction machine disclosed in JP-A 2000-192514, the excavation position and the dumping position are taught by the operator. Then, any deviation of the excavation position and any deviation of the dumping position during the work is corrected by image recognition with a video camera.

For example, for the dumping position, the vessel of the dumper truck is recognized on the basis of the image captured by the video camera. Also, in order to prevent an increase in cycle time, image processing during this correction is carried out such that the dumping position is identified prior to the excavation operation, and the excavation position is identified prior to the dumping operation, for example.

SUMMARY

However, in the image processing, it takes time to process a large amount of data, and even if the identification of the dumping position is started before the excavation operation, the image processing may not be completed before the end of the excavation operation, and it can be difficult to perform control quickly.

In light of the problems encountered with conventional work vehicles, it is an object of the present invention to provide a work vehicle, a work management system, and a work vehicle control method with which control can be performed more rapidly.

The work vehicle according to the first invention is a work vehicle comprising a traveling unit, a revolving unit disposed on the upper side of the traveling unit, and a work implement disposed on the revolving unit, said work vehicle further comprising a revolving unit drive device, a receiver, an end position setting component, a revolution position sensor, and a drive controller. The revolving unit drive device revolves the revolving unit. The receiver directly or indirectly receives information related to the position of an object serving as a target of the revolution of the revolving unit, from the object. The end position setting component sets the revolution end position of the revolving unit on the basis of information related to the position of the object. The revolution position sensor senses the revolution position of the revolving unit during a revolution. The drive controller controls the revolving unit drive device on the basis of the revolution position to revolve the revolving unit from the revolving start position to the revolving end position.

Information related to the position of the object that is the target of revolution, for setting the end position of the revolution, can be received from the outside. Consequently, there is no need to specify the end position by image processing, and control can be performed more quickly.

Also, with image processing in which a camera is used, it is sometimes difficult to recognize the end position because it is covered with earth, but since information related to the end position can be received from the outside, the end position can be more reliably recognized.

If, for example, a dumper truck is set as the target object, the work vehicle may receive information related to the position of the dumper truck directly from the dumper truck, or may receive information related to the position of the dumper truck indirectly from the dumper truck, via a work management system.

Also, the dumping position is not limited to a dumper truck, and may instead be the hopper of a crusher or the like.

The work vehicle according to the second invention is the work vehicle according to the first invention, wherein the object is a dumper truck, and the end position is a position included in the object.

Receiving information related to the position of the dumper truck allows the end position to be set without having to perform image processing or the like, and allows for automatic revolution to the position where the earth is to be dumped.

The work vehicle according to the third invention is the work vehicle according to the first invention, wherein the information related to the position of the object includes information related to the state of the vessel of the dumper truck.

Thus receiving information related to the state of the vessel allows the operator to recognize whether the vessel is in a tilted state (a state in which earth is dumped) or the vessel is in a horizontal state (a state in which earth is to be loaded).

Consequently, the work vehicle can be set not to revolve automatically toward the vessel in a state in which the vessel is tilted.

The work vehicle according to the fourth invention is the work vehicle according to the first invention, further comprising a revolution setting component that sets the speed or acceleration in the revolution of the revolving unit.

This allows the revolution speed or acceleration of the revolving unit in an automatic revolution to be set.

The work vehicle according to the fifth invention is the work vehicle according to the fourth invention, further comprising an orientation sensor and a load sensor. The orientation sensor senses the orientation of the work implement. The load sensor senses the load weight or fill ratio of the bucket of the work implement. The revolution setting component sets the speed or acceleration in a revolution on the basis of the orientation and the load weight.

Consequently, an appropriate revolution speed can be set on the basis of the orientation and loading status (load weight or fill ratio) of the work implement, so work efficiency can be improved.

When the revolution speed is not set on the basis of the orientation and loading status (load weight or fill ratio), it is possible to set it to the safest speed. For example, when the load weight of the bucket is light, the revolution speed can be set faster than when the weight is heavy, but for the sake of safety, it is set to the revolution speed when the loading weight is heavy.

On the other hand, setting the revolution speed on the basis of the orientation and loading status of the work implement as described above allows the revolution speed to be set to be faster when the load weight is light, so work efficiency can be improved.

The work vehicle according to the sixth invention is the work vehicle according to the first invention, further comprising a start position setting component and a load sensor. The load sensor senses the load weight or fill ratio of the bucket of the work implement. The start position setting component sets the position of the revolving unit when the load weight or the fill ratio has reached a specific value, as the start position.

Consequently, when the load weight or fill ratio of the bucket reaches a specific value, the revolution operation can be automatically started, using that position as the starting position.

The work management system for a work vehicle according to the seventh invention is a work management system for a work vehicle comprising a traveling unit, a revolving unit disposed on the upper side of the traveling unit, and a work implement disposed on the revolving unit, said system further comprising an end position setting component and a transmitter. The end position setting component sets the revolving end position of the revolving unit on the basis of information related to the position of an object serving as a target of the revolution of the revolving unit, received from the object. The transmitter senses the revolution position of the revolving unit during a revolution and transmits to the work vehicle an instruction to revolve the revolving unit from the revolving start position to the end position.

Thus, information related to the position of an object that is the target of revolution, which is used for setting the end position of the revolution, can be transmitted to the work vehicle. Consequently, there is no need to specify the end position by image processing, and control can be performed more quickly.

Also, with image processing in which a camera is used, it is sometimes difficult to recognize the end position because it is covered with earth, but since information related to the end position can be received from the outside, the end position can be more reliably recognized.

The control method for a work vehicle according to the eighth invention is a control method for a work vehicle comprising a traveling unit, a revolving unit disposed on the upper side of the traveling unit, and a work implement disposed on the revolving unit, said control method comprising an end position setting step and a drive control step. The end position setting step involves setting the end position of the revolution of the revolving unit on the basis of information related to the position of an object serving as a target of the revolution of the revolving unit, received from the object. The drive control step involves sensing the revolution position of the revolving unit during a revolution and revolving the revolving unit from the revolving start position to the end position.

Thus, information related to the position of an object that is the target of the revolution, which is used for setting the end position of the revolution, can be received from the outside. Consequently, there is no need to specify the end position by image processing, and control can be performed more quickly.

Also, with image processing in which a camera is used, it is sometimes difficult to recognize the end position because it is covered with earth, but since information related to the end position can be received from the outside, the end position can be more reliably recognized.

The present invention provides a work vehicle, a work management system, and a control method for a work vehicle, with which control can be performed more quickly.

DETAILED DESCRIPTION OF EMBODIMENT(S)

A hydraulic excavator according to one embodiment of the present invention will now be described through reference to the drawings.

1. Configuration

Figure 1:
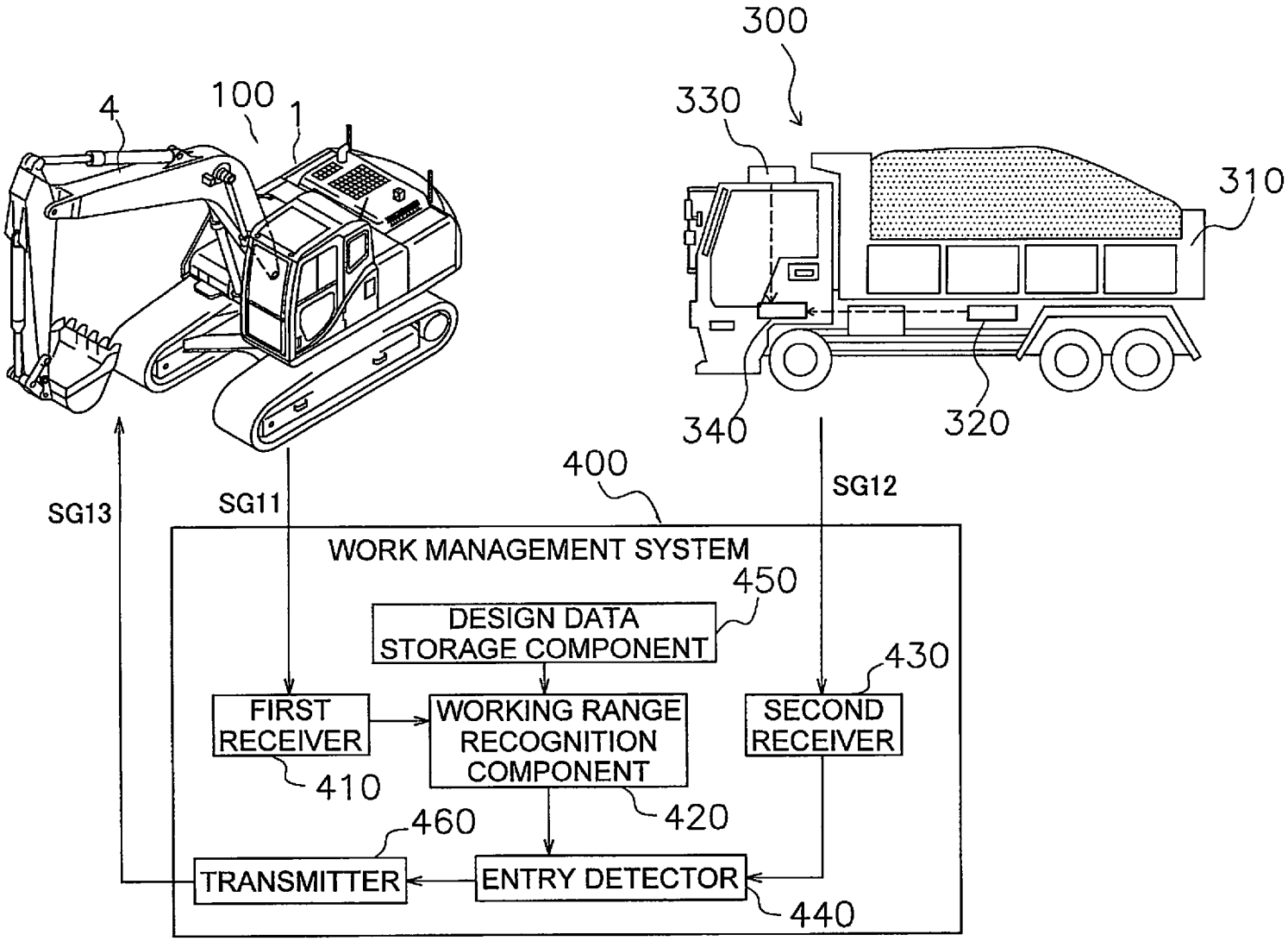
FIG. 1 is a diagram showing the relation between a hydraulic excavator, a work management system, and a dumper truck in an embodiment of the present invention.

FIG. 1 is a diagram of the relation between a hydraulic excavator 100, a work management system 400, and a dumper truck 300 in this embodiment.

The hydraulic excavator 100 in this embodiment transmits an excavator information signal SG11 to the work management system 400. The excavator information signal SG11 includes position information about the revolving unit 3, azimuth information about the revolving unit 3, orientation information of the work implement 4, and the like.

The dumper truck 300 transmits its own information as a dumper truck information signal SG12 to the work management system 400. The dumper track information signal SG12 includes position information about the dumper truck 300, the traveling direction of the dumper truck 300, the state of the vessel 310, and other such information.

The work management system 400 transmits information about the dumper truck 300, which is what the hydraulic excavator 100 loads the earth into, as a dumping target dumper truck information signal SG13 to the hydraulic excavator 100. The dumping target dumper truck information signal SG13 includes position information about the dumper truck 300 into which the earth will be dumped, information about the traveling direction of the dumper truck 300, information about the state of the vessel 310, and so forth.

The hydraulic excavator 100 performs automatic revolution from the excavating position to the dumper truck 300 (the object at the dumping position) on the basis of the received dumping target dumper truck information signal SG13.

1-1. Hydraulic Excavator 100

Figure 2:
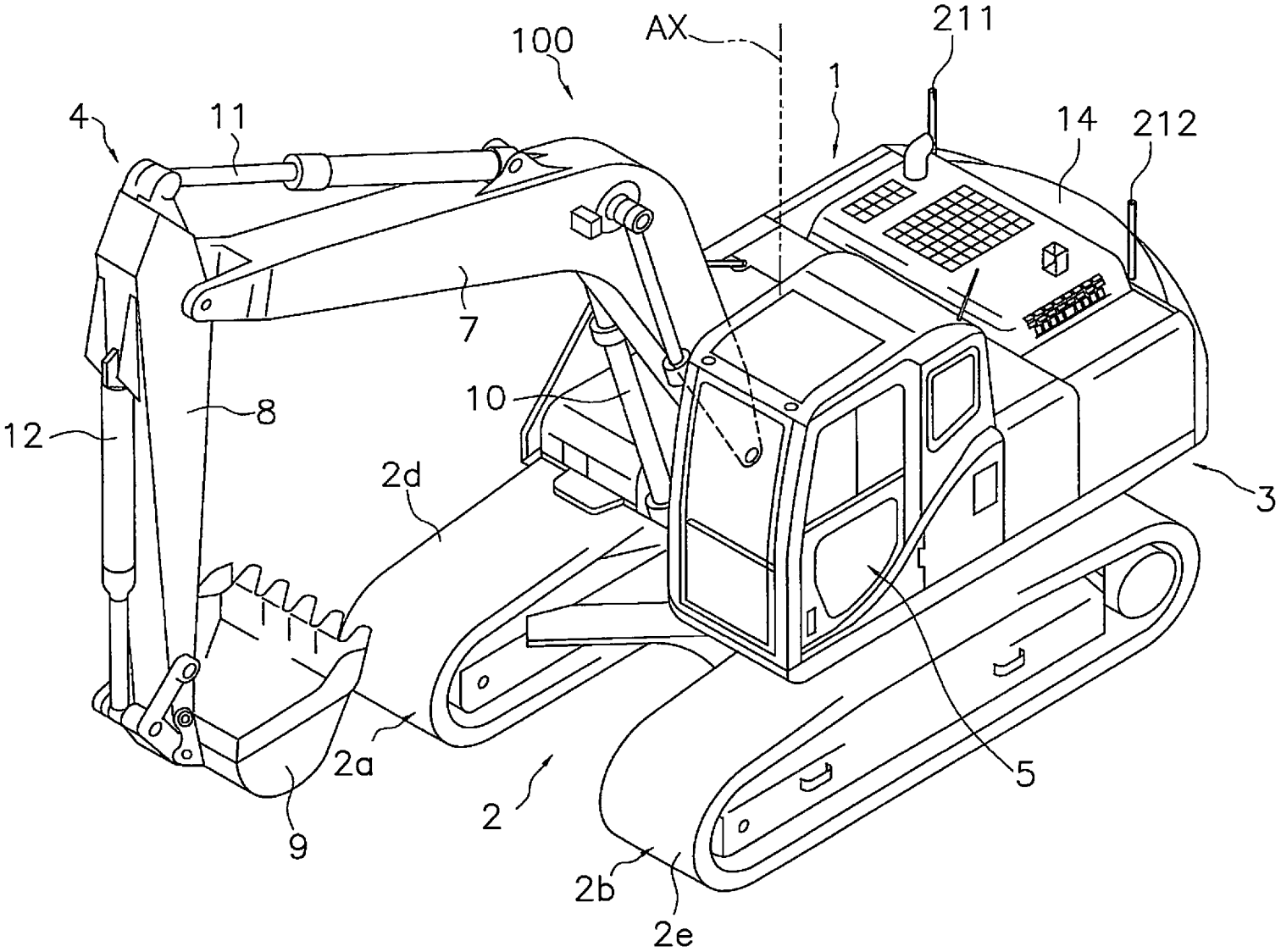
FIG. 2 is an external oblique view of a hydraulic excavator in an embodiment of the present invention.
Figure 3:
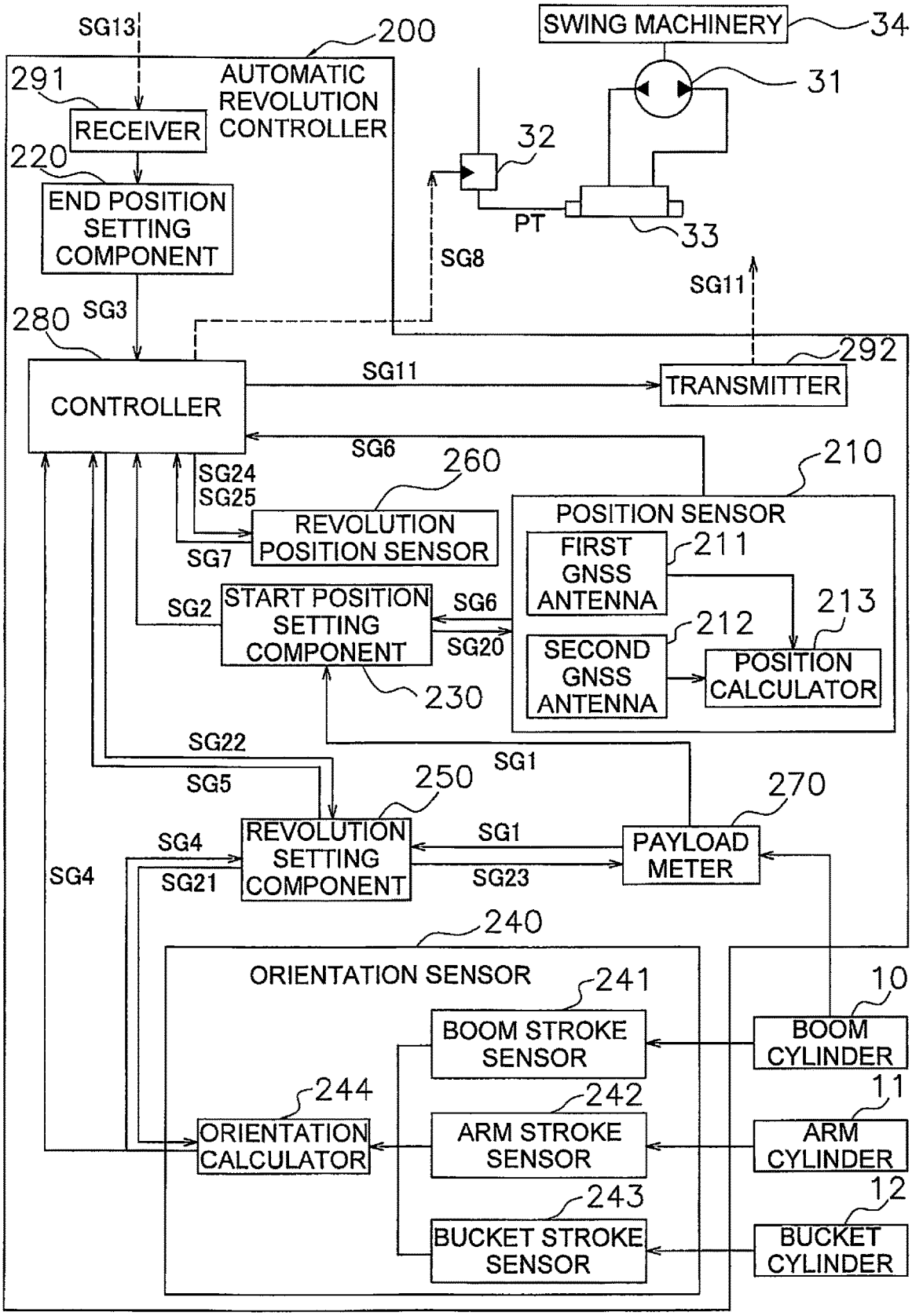
FIG. 3 is a block diagram of the configuration of an automatic revolution controller installed in the hydraulic excavator shown in FIG. 1.

As shown in FIG. 1, the hydraulic excavator 100 comprises a vehicle body 1 and a work implement 4. An automatic revolution control device 200 (see FIG. 3) is installed in the hydraulic excavator 100. FIG. 2 is an external oblique view of the hydraulic excavator 100. FIG. 3 is a block diagram showing part of the drive configuration for revolving the hydraulic excavator 100, and the configuration of the automatic revolution control device 200. First, the configuration of the hydraulic excavator 100 will be described, and the configuration of the automatic revolution control device 200 will be described later.

1-1-1. External Configuration of Hydraulic Excavator

As shown in FIG. 2, the vehicle body 1 has a traveling unit 2 and a revolving unit 3. The traveling unit 2 has a pair of traveling devices 2*a* and 2*b*. The traveling devices 2*a* and 2*b* have crawler belts 2*d* and 2*e*, and the crawler belts 2*d* and 2*e* are driven by the drive force from the engine, causing the hydraulic excavator 100 to travel.

The revolving unit 3 is arranged on the traveling unit 2. The revolving unit 3 is provided rotatably with respect to the traveling unit 2 around a revolution axis AX extending in the vertical direction. A revolution device (not shown) is provided to the revolving unit 3. The revolution device has a swing motor 31 (see FIG. 3), swing machinery 34 (see FIG. 3), an output pinion, and the like. A swing circle is provided to the traveling unit 2, and meshes with the output pinion. The rotational drive of the swing motor 31 is decelerated by the swing machinery 34 and outputted from the output pinion. Consequently, the swing machinery 34 rotates inside or outside the swing circle, and the revolving unit 3 rotates with respect to the traveling unit 2. As shown in FIG. 3, a control valve 33 for adjusting the amount of fluid supplied to the swing motor 31, and an EPC (electric proportional control) valve 32 for changing the pilot pressure (PT) at which the control valve 33 is operated are also provided.

As shown in FIG. 2, a cab 5 is provided as a driver's compartment at a position on the front left side of the revolving unit 3. A counterweight 14 is disposed at the rear end portion of the revolving unit 3. Also, the revolving unit 3 accommodates an engine (not shown), a hydraulic pump, and the like. In this embodiment, unless otherwise specified, the front, rear, left, and right will be described using the driver's seat in the cab 5 as a reference. The direction in which the driver's seat faces forward shall be referred to as the front direction, and the opposite direction from the front direction shall be referred to as the rear direction. The right and left sides in the lateral direction when the driver's seat is facing forward shall be termed the right and left directions, respectively.

The work implement 4 has a boom 7, an arm 8, and an excavation bucket 9, and is attached to the front center position of the revolving unit 3. More precisely, the work implement 4 is disposed on the right side of the cab 5. The proximal end portion of the boom 7 is rotatably linked to the revolving unit 3. Further, the distal end portion of the boom 7 is rotatably linked to the proximal end portion of the arm 8. The distal end portion of the arm 8 is rotatably linked to the excavation bucket 9. The excavation bucket 9 is attached to the arm 8 so that its opening can face in the direction of the vehicle body 1 (rearward). A hydraulic excavator in which the excavation bucket 9 is mounted facing in this way is called a backhoe. Also, hydraulic cylinders 10 to 12 (a boom cylinder 10, an arm cylinder 11, and a bucket cylinder 12) are disposed so as to correspond to the boom 7, the arm 8, and the excavation bucket 9, respectively. Driving these hydraulic cylinders 10 to 12 drives the work implement 4. As a result, excavation or other such work is performed.

1-1-2. Automatic Revolution Control Device 200

The automatic revolution control device 200 in this embodiment controls the swing motor 31 to revolve the revolving unit 3 automatically. The automatic revolution control device 200 mainly has a position sensor 210, an end position setting component 220, a start position setting component 230, an orientation sensor 240, a revolution setting component 250, a revolution position sensor 260, a payload meter 270, a controller 280, a receiver 291, and a transmitter 292.

1-1-2-1. Position Sensor 210

The position sensor 210 senses position information about the revolving unit 3 and azimuth information about the revolving unit 3, generates a position information signal SG6, and outputs the position information signal SG6 to the controller 280 at specific intervals. Also, the position sensor 210 receives a request signal SG20 from the start position setting component 230 and outputs the position information signal SG6 to the start position setting component 230.

The position sensor 210 has a first GNSS antenna 211, a second GNSS antenna 212, and a position calculator 213.

The first GNSS antenna 211 and the second GNSS antenna 212 are disposed on the counterweight 14 as shown in FIG. 2. The first GNSS antenna 211 and the second GNSS antenna 212 are antennas for RTK-GNSS (real time kinematic-global navigation satellite system). The first GNSS antenna 211 and the second GNSS antenna 212 are disposed a specific distance apart in the width direction of the revolving unit 3. The first GNSS antenna 211 receives first reception position information indicating the position of its device from a positioning satellite. The second GNSS antenna 212 receives second reception position information indicating the position of its device from a positioning satellite. The first GNSS antenna 211 and the second GNSS antenna 212 output the first and second reception position information to the position calculator 213.

The position calculator 213 calculates position information about the revolving unit 3 and azimuth information about the revolving unit 3 on the basis of the first and second reception position information in two places.

Position information about the revolving unit 3 is position information about the revolving unit 3 in a global coordinate system (this can also be called position information about the hydraulic excavator 100). The position information may be obtained using either the first or the second reception position information, or both may be used.

Azimuth information is the angle of a straight line connecting the positions of the first GNSS antenna 211 and the second GNSS antenna 212 obtained from the reception position information P1 and P2 with respect to a reference azimuth (such as north) in the global coordinates. This angle is found by calculation by the position calculator 213, and indicates the azimuth in which the work implement 4 is facing.

The position sensor 210 transmits the position information signal SG6 to the start position setting component 230 only when a request signal SG20 has been received from the start position setting component 230, but may output the position information signal SG6 to the start position setting component 230 at specific intervals.

1-1-2-2. Payload Meter 270

The payload meter 270 measures the load weight of earth. etc., in the excavation bucket 9. The payload meter 270 senses the pressure of the boom cylinder 10 and senses the load weight in the excavation bucket 9.

The payload meter 270 generates a weight sensing signal SG1 including information about the sensed load weight, and outputs it to the start position setting component 230. Also, the payload meter 270 receives a request signal SG23 from the revolution setting component 250 and outputs the weight sensing signal SG1 to the revolution setting component 250.

1-1-2-3. Start Position Setting Component 230

The start position setting component 230 sets the start position for automatic revolution on the basis of the sensing result of the payload meter 270. The start position setting component 230 acquires the weight sensing signal SG1 including information about the load weight from the payload meter 270.

When the load weight in the excavation bucket 9 reaches a specific value, the start position setting component 230 transmits the request signal SG20 to the position sensor 210, receives the position information signal SG6 from the position sensor 210, and sets the position (position and azimuth) of the revolving unit 3 at that point as the start position.

Then, the start position setting component 230 generates a start position signal SG2 including information about the set starting position, and outputs it to the controller 280.

1-1-2-4. End Position Setting Component 220

The end position setting component 220 specifies the end position of automatic revolution on the basis of the dumping target dumper truck information signal SG13 received from the work management system 400.

As will be described below, the dumping target dumper truck information signal SG13 includes position information about the dumper truck 300 into which the hydraulic excavator 100 is to dump earth, information about the traveling direction, and information related to the state of the vessel 310 (see FIG. 1).

When the receiver 291 receives the dumping target dumper truck information signal SG13, the end position setting component 220 sets the position of the vessel 310 as the end position of automatic revolution. Then, the end position setting component 220 generates an end position signal SG3 including information related to the set end position, and outputs it to the controller 280.

1-1-2-5. Orientation Sensor 240

The orientation sensor 240 senses the orientation of the work implement 4. The orientation sensor 240 has a boom stroke sensor 241, an arm stroke sensor 242, a bucket stroke sensor 243, and an orientation calculator 244.

The boom stroke sensor 241 senses the stroke of the boom cylinder 10. The arm stroke sensor 242 senses the stroke of the arm cylinder 11. The bucket stroke sensor 243 senses the stroke of the bucket cylinder 12. The strokes of the hydraulic cylinders 10 to 12 are sensed by these stroke sensors 241, 242, and 243.

The orientation calculator 244 calculates the orientations of the boom 7, the arm 8, and the excavation bucket 9 from the sensed strokes of the hydraulic cylinders 10 to 12. From the strokes of the hydraulic cylinders 10 to 12, the orientation calculator 244 calculates the rotation angle of the boom 7 with respect to the revolving unit 3, the rotation angle of the arm 8 with respect to the boom 7, and the rotation angle of the excavation bucket 9 with respect to the arm 8, and specifies the orientation of the work implement 4. The orientation calculator 244 then generates an orientation signal SG4 including the information related to the specified orientation of the work implement 4, and outputs this signal to the controller 280 and the revolution setting component 250. The orientation sensor 240 outputs the orientation signal SG4 to the controller 280 at specific intervals. Also, the orientation sensor 240 receives a request signal SG21 from the revolution setting component 250 and outputs the orientation signal SG4 to the revolution setting component 250. The orientation sensor 240 may also output the orientation signal SG4 to the revolution setting component 250 at specific intervals.

1-1-2-6. Revolution Setting Component 250

The revolution setting component 250 receives a setting instruction signal SG22 from the controller 280, transmits the request signal SG21 to the orientation sensor 240, and transmits the request signal SG23 to the payload meter 270. As a result, the revolution setting component 250 receives the orientation signal SG4 transmitted from the orientation sensor 240 and the weight sensing signal SG1 from the payload meter 270, and sets the speed and acceleration during automatic revolution of the revolving unit 3 on the basis of the orientation of the work implement 4 and the load weight found by the payload meter 270.

For example, the revolution setting component 250 stores in advance the distance of the excavation bucket 9 from the revolution center and the load weight, as well as the revolution speed and acceleration (including both acceleration and deceleration) with respect to the combination of the distance and the load weight, in the form of a table. In this table, for example, at a given load weight, the greater is the distance of the excavation bucket 9 from the revolution center, the higher is the centrifugal force, so the revolution speed and acceleration are set low.

The revolution setting component 250 outputs a revolution setting signal SG5, which includes information related to the set speed and acceleration during automatic revolution, to the controller 280.

1-1-2-7. Revolution Position Sensor 260

The revolution position sensor 260 receives a request signal SG24 from the controller 280, senses information related to the revolution position of the revolving unit 3 at specific intervals during revolution, and transmits a revolution position signal SG7 including this information to the controller 280.

The revolution position sensor 260 is, for example, a sensor provided to the swing motor 31, or a sensor that senses the teeth of the swing machinery 34.

The revolution position sensor 260 receives an end instruction signal SG25 from the controller 280 when the revolution has ended, and stops the transmission of the revolution position signal SG7 to the controller 280.

1-1-2-8. Controller 280

The controller 280 receives the position information signal SG6 including the position information specified by the position sensor 210, and the orientation signal SG4 including the orientation information specified by the orientation sensor 240, at specific intervals, and generates the excavator information signal SG11 and transmits it to the work management system 400 via the transmitter 292. Consequently, the excavator information signal SG11 includes position information about the revolving unit 3, azimuth information about the revolving unit 3, orientation information about the work implement 4, and the like.

Also, the controller 280 receives the start position signal SG2 and the end position signal SG3, transmits the setting instruction signal SG22 to the revolution setting component 250, and receives the revolution setting signal SG5 from the revolution setting component 250.

In starting a revolution, the controller 280 transmits the request signal SG24 to the revolution position sensor 260, and receives the revolution position signal SG7 from the revolution position sensor 260 at specific intervals.

The controller 280 generates the control signal SG8 from the start position signal SG2, the end position signal SG3, the revolution setting signal SG5, and the revolution position signal SG7, and controls the EPC valve 32. The EPC valve 32 changes the pilot pressure for operating the spool of the control valve 33 that controls the amount of fluid for rotating the swing motor 31. When the aperture of the EPC valve 32 is changed by the controller 280, the pilot pressure (PT) changes, the amount of fluid delivered from the control valve 33 changes, and the rotation of the swing motor 31 also changes.

When the controller 280 detects from the revolution position signal SG7 that the position of the revolving unit 3 has reached the end position, the controller 280 transmits the end instruction signal SG25 to the revolution position sensor 260, and the sensing of the revolution position is halted.

1-2. Dumper Truck 300

As shown in FIG. 1, the dumper truck 300 mainly has a vessel 310, a vessel sensor 320, a GPS device 330, and a transmitter 340.

The vessel 310 is in a horizontal state when earth is being loaded by the hydraulic excavator 100, and the front portion is lifted to a tilted state when the loaded earth is to be dumped. The vessel sensor 320 detects whether the vessel 310 is in a tilted state or a horizontal state.

The GPS device 330 identifies the position of the dumper truck 300 as a global coordinate system (X, Y, Z). The GPS device 330 can also acquire information about the traveling direction of the dumper truck 300.

The transmitter 340 transmits the dumper truck information signal SG12 to the work management system 400. The dumper truck information signal SG12 includes traveling direction information and position information about the dumper truck 300 sensed by the GPS device 330, as well as information related to the state of the vessel 310 sensed by the vessel sensor 320.

Since the traveling direction information about the dumper truck 300 acquired by the GPS device 330 matches information about the orientation of the vessel 310, the dumper track information signal SG12 also includes information about the orientation of the vessel 310. However, this is not the only option, and two GPNSS antennas may be disposed diagonally in the vessel 310, allowing information related to the orientation of the vessel 310 to be acquired in more detail, and this information related to orientation may be transmitted to the work management system 400.

1-3. Work Management System 400

As shown in FIG. 1, the work management system 400 is provided in a cloud, for example, and is provided with a first receiver 410, a second receiver 430, a working range recognition component 420, an entry detector 440, a transmitter 460, and a design data storage component 450.

The first receiver 410 receives the excavator information signal SG11 transmitted from the hydraulic excavator 100.

Figure 4:
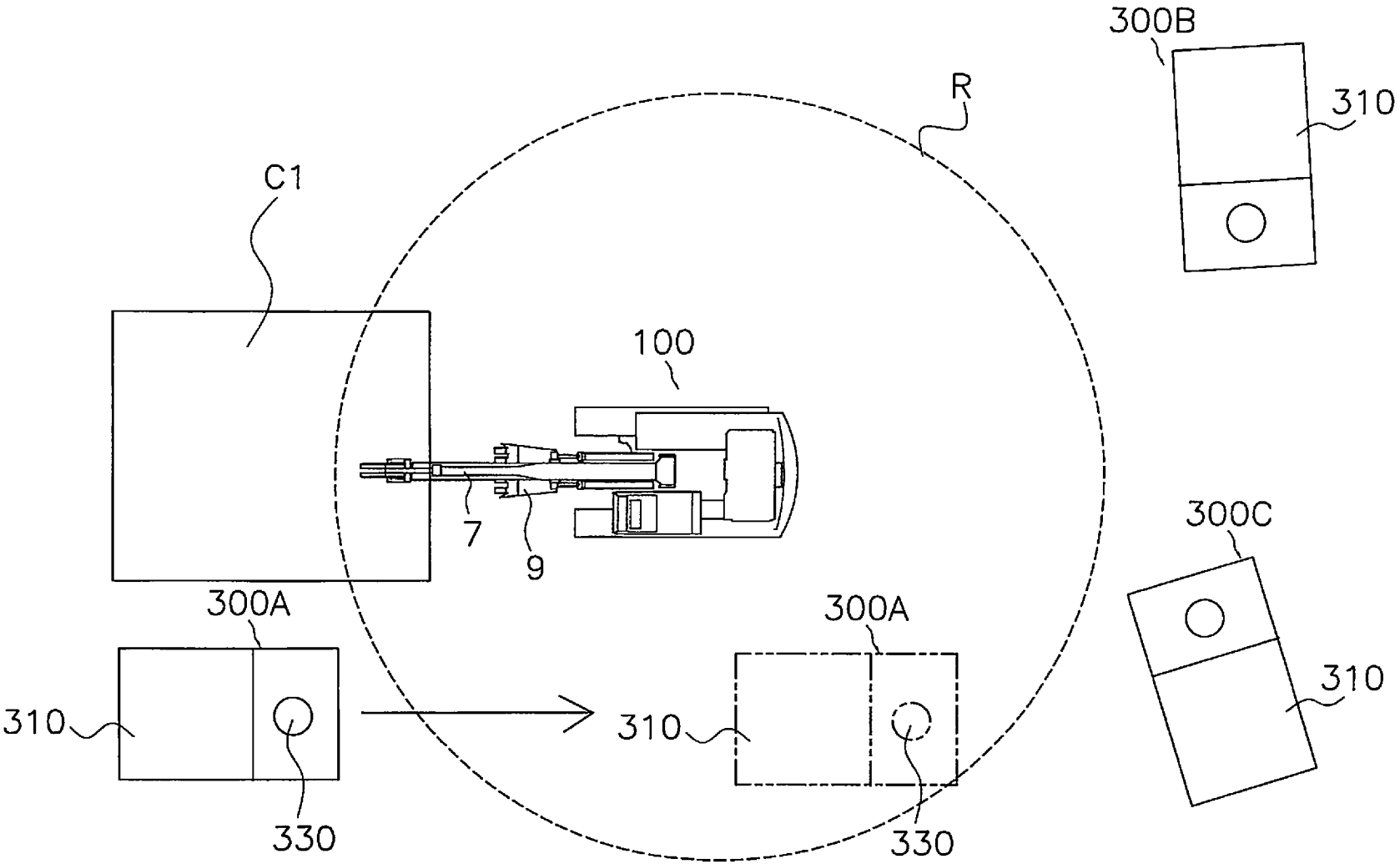
FIG. 4 is a plan view of the working range of the hydraulic excavator in FIG. 1.

The working range recognition component 420 recognizes a working range R from the design data stored in the design data storage component 450 and the excavator information signal SG11 of the hydraulic excavator 100. The excavator information signal SG11 includes the orientation information about the work implement 4, the position information about the revolving unit 3, and the azimuth information about the revolving unit 3. The working range recognition component 420 recognizes the working range R from these pieces of information. FIG. 4 is a plan view of the working range R of the hydraulic excavator 100. The design data includes construction data and the like for the construction site C1 shown in FIG. 4.

If the working range recognition component 420 has determined from the orientation information about the work implement 4 that work by the work implement 4 is not being performed, the working range recognition component 420 need not recognize the working range R.

The working range R is recognized as the range that can be reached by the work implement 4, for example. Also, the working range recognition component 420 recognizes the working range R in global coordinates.

The second receiver 430 receives the dumper truck information signal SG12 from the dumper truck 300. The second receiver 430 receives the dumper truck information signal SG12 from a plurality of dumper trucks 300.

The entry detector 440 detects that one of the dumper trucks 300 has entered the working range R recognized by the working range recognition component 420. For example, as shown in FIG. 4, the entry detector 440 receives the dumper truck information signal SG12 at specific intervals from dumper trucks 300A, 300B, and 300C, and it is detected from the position information thereof that the dumper truck 300A has entered the working range R. FIG. 4 shows a state in which the dumper truck 300A that was outside the working range R has entered the working range R. The dumper truck 300A within the working range R is indicated by two-dot chain lines, and the dumper truck 300A outside the working range R is indicated by solid lines.

The transmitter 460 transmits the dumper truck information signal S12 for the dumper truck 300 whose entry into the working range R was detected (the dumper truck 300A in FIG. 4), to the hydraulic excavator 100 as the dumping target dumper truck information signal SG13.

As described above, the hydraulic excavator 100 receives the dumping target dumper truck information signal SG13 and specifies the end position of automatic revolution.

2. Operation 2-1. Operation of Work Management System

First, the operation of the work management system will be described.

Figure 5:
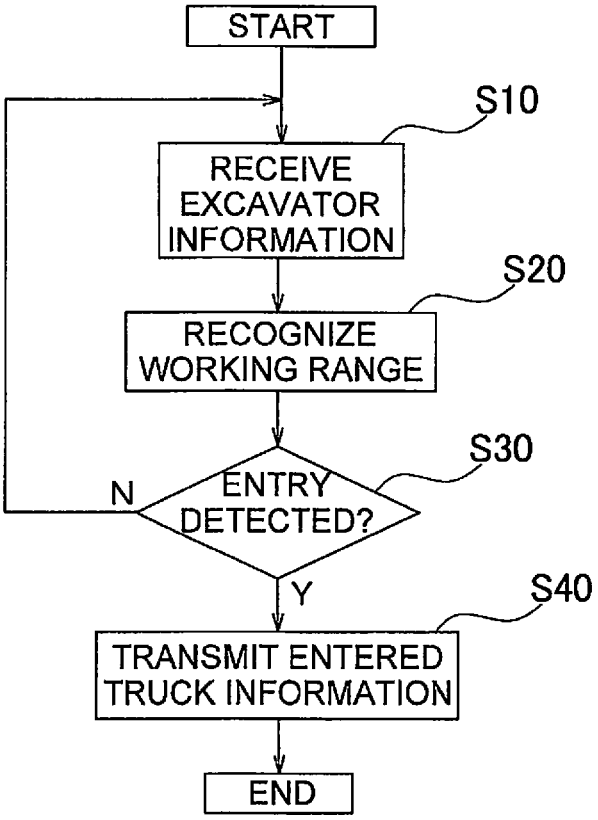
FIG. 5 is a flowchart of the operation of the work management system in FIG. 1.

FIG. 5 is a flowchart of the operation of the work management system 400 in this embodiment.

In step S10, the first receiver 410 of the work management system 400 receives the excavator information signal SG11 transmitted at specific intervals from the position sensor 210 of the hydraulic excavator 100.

Next, in step S20, the working range recognition component 420 recognizes the working range R of the hydraulic excavator 100 (see FIG. 4) from the excavator information signal SG11 on the basis of the design data stored in the design data storage component 450.

Next, in step S30, the entry detector 440 detects the entry of the dumper truck 300 into the working range R on the basis of the dumper truck information signals SG12 received at specific intervals by the second receiver 430. If the entry detector 440 detects the entry of the dumper truck 300 into the working range in step S30, in step S40 the transmitter 460 transmits the dumper truck information signal SG12 of the entered dumper truck to the hydraulic excavator 100 as the dumping target dumper truck information signal SG13.

2-2. Operation of Hydraulic Excavator

Next, the operation of the hydraulic excavator 100 in this embodiment will be described.

Figure 6:
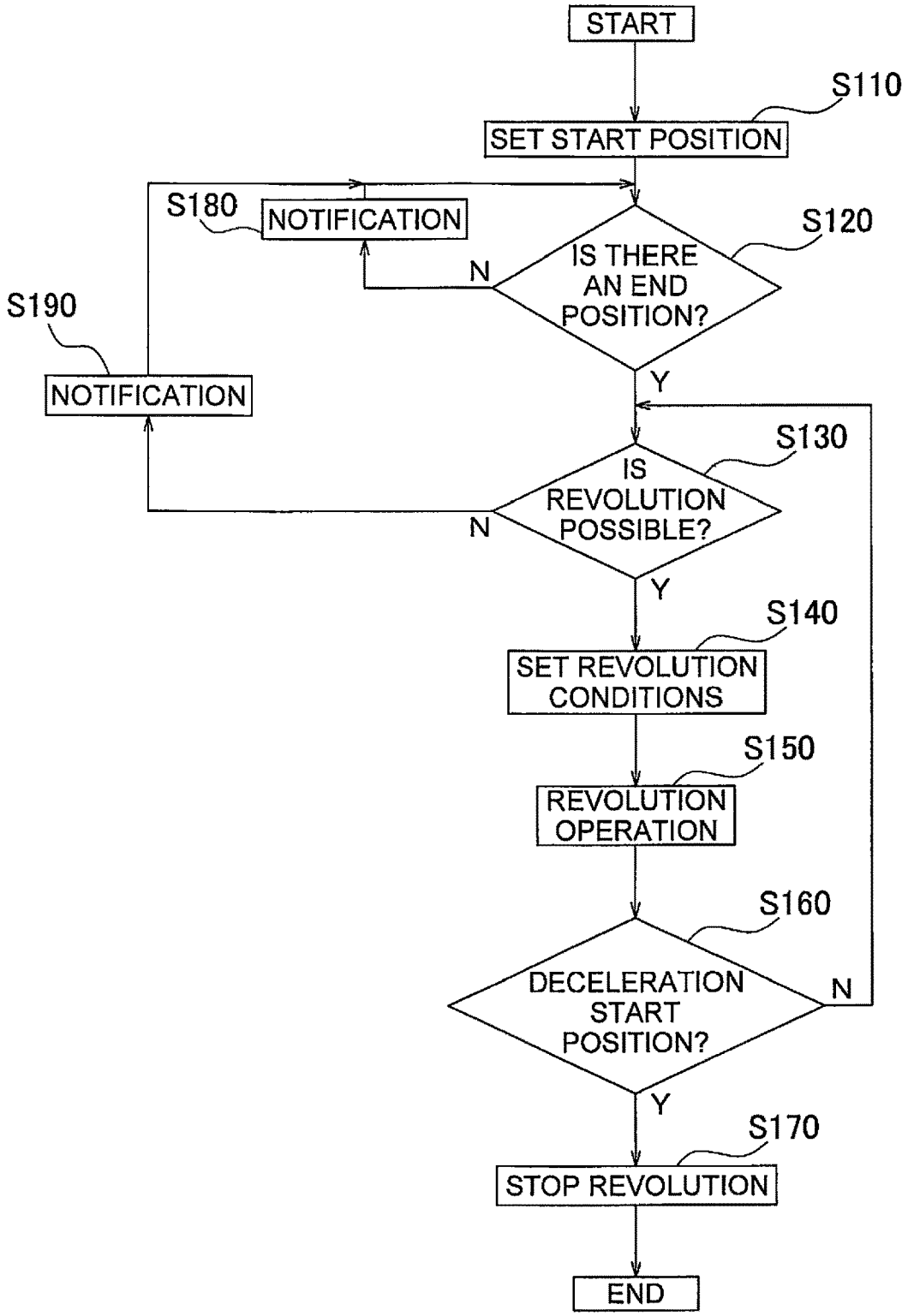
FIG. 6 is a flowchart of the operation of the hydraulic excavator in FIG. 1.

FIG. 6 is a flowchart of the operation of the hydraulic excavator 100 in this embodiment.

Figure 7:
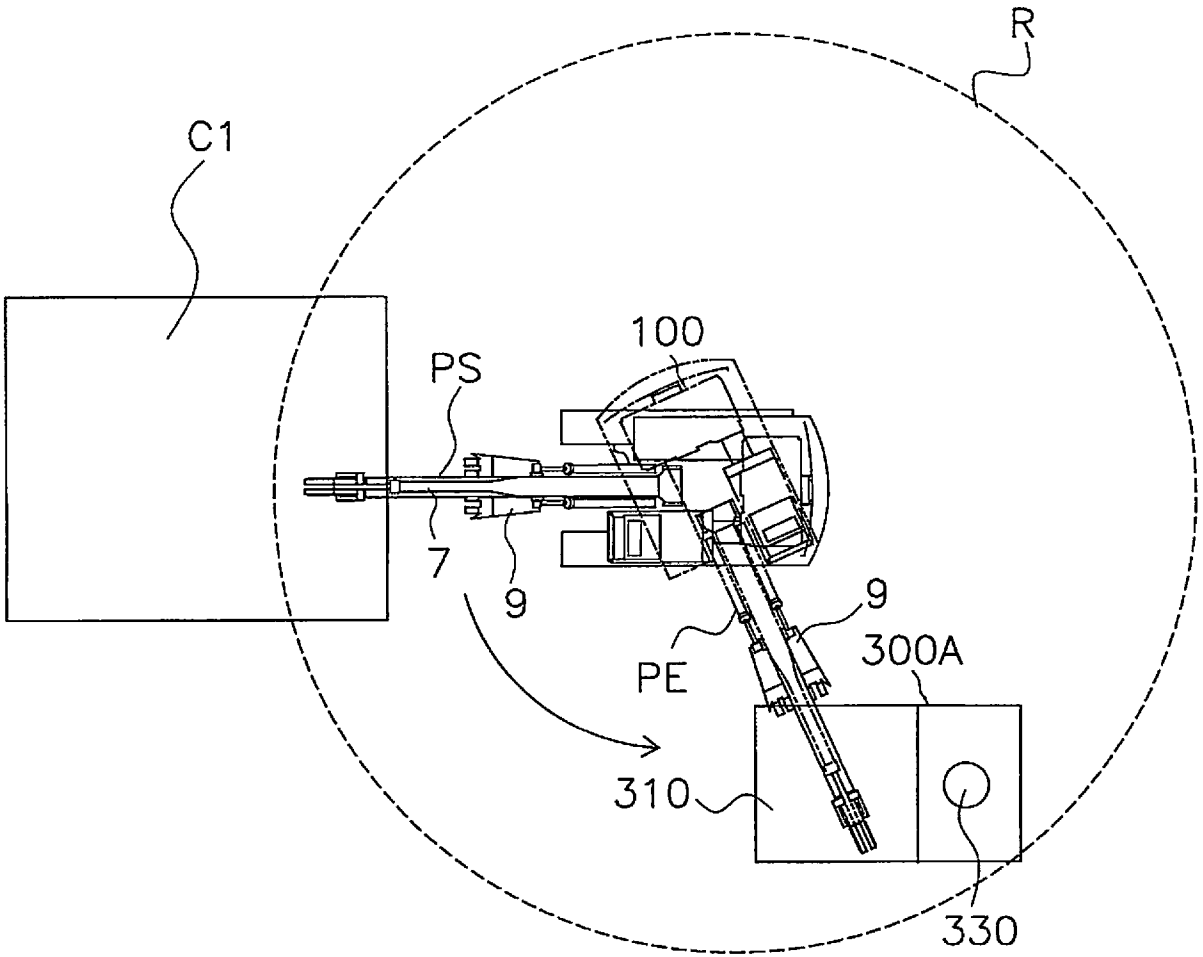
FIG. 7 is a plan view of the working range of the hydraulic excavator in FIG. 1.

When it is determined in step S110 that the load weight of the excavation bucket 9 has reached a specific value on the basis of the weight sensing signal SG1 of the payload meter 270, the start position setting component 230 sets the position of the revolving unit 3 at that point as the start position. More precisely, the start position setting component 230 transmits the request signal SG20 to the position sensor 210 when the load weight reaches a specific value. Consequently, the start position setting component 230 can specify the position of the revolving unit 3 when the load weight reaches the specific value, on the basis of the position information signal SG6 transmitted from the position sensor 210. The start position setting component 230 then generates a start position signal SG2 including information related to the start position, using the specified position as the start position, and outputs this signal to the controller 280. FIG. 7 is a plan view of the working state of the hydraulic excavator 100. FIG. 7 shows a state in which the revolving unit 3, which is indicated by solid lines, is disposed in the start position PS. As shown in FIG. 7, the revolving unit 3 is disposed facing the construction site C1, and the start position PS is the position where construction is underway.

Next, in step S120, the controller 280 determines whether or not there is an end position. After receiving the start position signal SG2 from the start position setting component 230, the controller 280 determines whether or not the end position signal SG3 has been received from the end position setting component 220. When the receiver 291 receives the dumping target dumper truck information signal SG13 from the work management system 400, the end position setting component 220 sets the end position and outputs the end position signal SG3 to the controller 280. Therefore, if the controller 280 has received the end position signal SG3, it means the dumper truck 300 has entered the working range R and there is an end position.

In FIG. 7, the position (position and direction) of the revolving unit 3 in which the dumper truck 300A has entered the working range R and the work implement 4 is facing the dumper truck 300A is set as the end position PE. Also, the work implement 4 disposed at the end position PE is indicated by two-dot chain lines. On the other hand, if the controller 280 has not received the end position signal SG3, it means that the dumper truck 300 has not entered the working range R and there is no end position (the position where the excavated earth is to be dumped).

If there is no end position, the operator is notified to that effect in step S180. This notification is made by voice or display. In this case, control is performed to leave the hydraulic excavator 100 in standby mode until there is an end position.

If there is an end position, in step S130 the controller 280 determines whether or not revolution is possible. For example, the controller 280 determines, on the basis of the received dumping target dumper truck information signal SG13, that revolution is not possible if the vessel 310 of the dumper truck 300 is in a tilted state rather than a horizontal state.

If it is determined in step S130 that revolution is not possible, in step S190 the operator is notified that the revolution to the dumper truck 300A is impossible. In this case, the control returns to step S120, and control is performed so that the hydraulic excavator 100 is left in standby mode until there is a new end position.

In step S130, if the vessel 310 is in a horizontal state and the controller 280 has determined that revolution is possible, in step S140 the revolution setting component 250 sets the speed and acceleration during revolution.

More precisely, the controller 280 transmits the setting instruction signal SG22 to the revolution setting component 250. The revolution setting component 250 transmits the request signal SG21 to the orientation sensor 240 and transmits the request signal SG23 to the payload meter 270. In the revolution setting component 250, the strokes of the boom cylinder 10, the arm cylinder 11, and the bucket cylinder 12 are sensed by the boom stroke sensor 241, the arm stroke sensor 242, and the bucket stroke sensor 243, respectively. The orientation calculator 244 calculates the orientation of the work implement 4 from the detected strokes, and transmits the orientation signal SG4 to the revolution setting component 250. Also, the payload meter 270 transmits the weight sensing signal SG1 to the revolution setting component 250. The revolution speed and acceleration with respect to the load weight and orientation are stored in advance in the form of a table in the revolution setting component 250, and the revolution speed and acceleration are set on the basis of this table from the orientation signal SG4 and the weight sensing signal SG1.

Next, in step S150, the controller 280 generates the control signal SG8 on the basis of the revolution position signal SG7 from the revolution position sensor 260, so as to achieve the conditions of the start position signal SG2, the end position signal SG3, and the revolution setting signal SG5, and transmits this control signal SG8 to the EPC valve 32. Consequently, the aperture of the EPC valve 32 is controlled and the pilot pressure is adjusted. The control valve 33 is operated, the drive of the swing motor 31 is controlled, and the revolving unit 3 performs a revolution. When a revolution is begun, the controller 280 transmits the request signal SG24 to the revolution position sensor 260 and receives the revolution position signal SG7 at specific intervals from the revolution position sensor 260. The controller 280 can specify the position of the revolving unit 3 at every moment of revolution by means of the revolution position signal SG7, and the controller 280 controls the EPC valve 32 on the basis of this revolution position.

Next, in step S160, when it is detected from the revolution position signal SG7 from the revolution position sensor 260 that the deceleration position has been reached, the controller 280 controls the EPC valve 32 to start decelerating, and stops the revolving unit 3 at the position PE in step S170.

As described above, the revolving unit 3 can be made to revolve automatically from the start position PS to the end position PE.

3. Features, Etc.

(3-1)

The hydraulic excavator 100 (an example of a work vehicle) in this embodiment comprises the traveling unit 2 (an example of a traveling unit), the revolving unit 3 (an example of a revolving unit) disposed on the upper side of the traveling unit 2, and the work implement 4 disposed on the revolving unit 3, and further comprises the swing motor 31 (an example of a revolving unit drive device), the receiver 291, the end position setting component 220, the revolution position sensor 260, and the controller 280 (an example of a drive controller). The swing motor 31 revolves the revolving unit 3. The receiver 291 indirectly receives the dumping target dumper truck information signal SG13 (an example of information related to the position of an object that is the target of the revolution of the revolving body) from the dumper truck 300 (an example of the object) via the work management system 400. The end position setting component 220 sets the end position PE of the revolution of the revolving unit 3 on the basis of the dumping target dumper truck information signal SG13. The revolution position sensor 260 senses the revolution position of the revolving unit 3 during revolution. The controller 280 controls the swing motor 31 so as to cause the revolving unit 3 to revolve from the revolution start position PS to the end position PE on the basis of the revolution position.

Information related to the position of the dumper truck 300 (the object that is the target of the revolution), for setting the revolution end position PE, can thus be received from the outside. Consequently, there is no need to specify the end position PE by image processing, and control can be performed more quickly.

Also, with image processing in which a camera is used, it is sometimes difficult to recognize the end position because it is covered with earth, but since information related to the end position can be received from the outside, the end position can be more reliably recognized.

(3-2)

With the hydraulic excavator 100 (an example of a work vehicle) in this embodiment, the end position PE is a position included in the dumper truck 300 (an example of an object).

Receiving information related to the position of the dumper truck 300 makes it possible to set the end position without having to perform image processing or the like.

In the above embodiment, the end position PE is the vessel 310 of the dumper truck 300.

(3-3)

With the hydraulic excavator 100 (an example of a work vehicle) in this embodiment, the dumping target dumper truck information signal SG13 (an example of information related to the position of an object that is the target of the revolution of the revolving unit) includes information related to the state of the vessel 310 of the dumper truck 300.

Receiving information related to the state of the vessel 310 in this manner makes it possible to recognize whether the vessel 310 is in a tilted state or a horizontal state.

Consequently, when the vessel 310 is in a tilted state, the vehicle can be set not to perform automatic revolution toward the vessel 310.

(3-4)

The hydraulic excavator 100 (an example of a work vehicle) in this embodiment further comprises the revolution setting component 250 that sets the speed or acceleration in a revolution of the revolving unit 3.

This makes it possible to set the revolution speed or acceleration of the revolving unit 3 during automatic revolution.

(3-5)

The hydraulic excavator 100 (an example of a work vehicle) in this embodiment further comprises the orientation sensor 240 and the payload meter 270 (an example of a load sensor). The boom stroke sensor 241, the arm stroke sensor 242, and the bucket stroke sensor 243 sense the orientation of the work implement 4. The payload meter 270 senses the load weight of the excavation bucket 9 (an example of a bucket) of the work implement 4. The revolution setting component 250 sets the speed or acceleration in a revolution on the basis of the orientation and the load weight.

As a result, an appropriate revolution speed can be set on the basis of the orientation and load weight of the work implement 4, so work efficiency can be improved.

When the revolution speed is not set on the basis of the orientation and loading status (load weight or fill ratio), it is possible to set it to the safest speed. For example, when the load weight of the excavation bucket 9 is light, the revolution speed can be set faster than when the weight is heavy, but for the sake of safety, it is set to the revolution speed when the loading weight is heavy.

On the other hand, setting the revolution speed on the basis of the orientation and loading status of the work implement as described above allows the revolution speed to be set to be faster when the load weight is light, so work efficiency can be improved.

(3-6)

The hydraulic excavator 100 (an example of a work vehicle) in this embodiment comprises the start position setting component 230 and the payload meter 270 (an example of a load sensor). The payload meter 270 senses the load weight of the excavation bucket 9 of the work implement 4. The start position setting component 230 sets the position of the revolving unit 3 at the point when the loaded weight has reached a specific value as the start position PS.

Consequently, when the load weight of the excavation bucket 9 reaches a specific value, the revolution operation can be automatically started, using that position as the starting position.

(3-7)

The method for controlling the hydraulic excavator 100 (an example of a work vehicle) in this embodiment is a method for controlling the hydraulic excavator 100 comprising the traveling unit 2 (an example of a traveling unit), the revolving unit 3 (an example of a revolving unit) disposed on the upper side of the traveling unit 2, and the work implement 4 disposed on the revolving unit 3, said method comprising a step S110 (an example of a start position setting step), a step S120 (an example of an end position setting step), and a step S150 (an example of a drive control step). In step S110, the revolution start position PS of the revolving unit 3 is set. In step S120, the revolution end position PE of the revolving unit 3 is set on the basis of the dumping target dumper truck information signal SG13 (an example of information related to the position of an object that is the target of revolution of the revolving unit) received from the dumper truck 300 (an example of an object) that is the target of the revolution of the revolving unit 3 via the work management system 400. In step S150, the revolution position during a revolution is sensed so as to control the swing motor 31 for driving the revolving unit 3 so that the revolving unit 3 revolves from the start position PS to the end position PE.

Information related to the position of the dumper truck 300 (an object that is the target of the revolution), used for setting the revolution end position PE, can thus be received from the outside. Consequently, there is no need to specify the end position PE by image processing, and control can be performed more quickly.

Also, with image processing in which a camera is used, it is sometimes difficult to recognize the end position because it is covered with earth, but since information related to the end position can be received from the outside, the end position can be more reliably recognized.

4. Other Embodiments

An embodiment of the present invention was described above, but the present invention is not limited to or by the above embodiment, and various modifications are possible without departing from the gist of the invention.

(A)

In the above embodiment, the dumper truck 300 was described as an example of the object into which the hydraulic excavator 100 dumped, but a dumper truck is not the only option, and the hopper of a crusher or the like may be used instead.

(B)

In the above embodiment, as shown in FIG. 7, control was described in which the revolving unit 3 was automatically revolved from the start position PS to the end position PE, using the construction site C1 as the start position PS and the vessel 310 as the end position PE, but the revolving unit 3 may also be automatically revolved when it is returned from the vessel 310 to the construction site C1.

Figure 8:
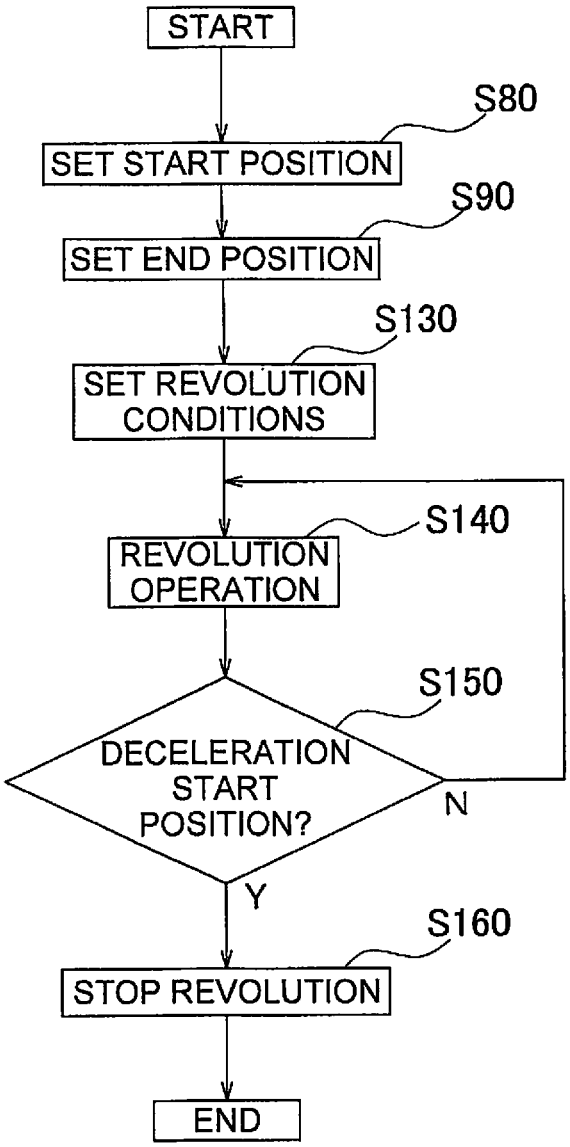
FIG. 8 is a flowchart of another example of the operation of the hydraulic excavator in FIG. 1.

FIG. 8 shows the operation flow of the hydraulic excavator 100 when the revolving unit 3 is returned from the vessel 310 to the construction site C1. In step S80, when it is detected from the weight sensing signal SG1 of the payload meter 270 that the excavation bucket 9 has dumped its earth, the start position setting component 230 sets the position of the revolving unit 3 at that point as the start position PS. The position of the revolving unit 3 is acquired as the position information signal SG6 from the position sensor 210. In step S90, the end position setting component 220 sets the construction site C1 (the previous start position) as the current end position, for example. Next, in step S130, the speed and acceleration during revolution are set just as in the above embodiment, and in step S140 the swing motor 31 is controlled to perform a revolution operation. Then, in step S150, when the revolving unit 3 reaches a deceleration position, the swing motor 31 is controlled, and in step S160 the revolving unit 3 stops at the end position (the construction site C1).

(C)

In the above embodiment, the revolution position sensor 260 is a sensor provided to the swing motor 31 or a sensor that senses the teeth of the swing machinery, but the position sensor 210 may also serve as the revolution position sensor 260. That is, the position sensor 210 may specify the revolution position (the position and the azimuth of the revolving unit 3) of the revolving unit 3 during revolution.

(D)

In the above embodiment, the work management system 400 is provided, but it need not be provided. In this case, as with the automatic revolution control device 200' shown in FIG. 9, the working range recognition component 420, the entry detector 440, and the design data storage component 450 are provided to the hydraulic excavator 100. The working range recognition component 420 recognizes the working range R on the basis of the design data, the position information signal SG6, and the orientation signal SG4. The receiver 291 receives the dumper truck information signal SG12 directly from the plurality of dumper trucks 300. The entry detector 440 detects a dumper truck 300 that has entered the working range R, and transmits the dumper truck information signal SG12 of the dumper truck 300 whose entry was detected to the end position setting component 220 as the dumping target dumper truck information signal SG13. The end position setting component 220 then sets the position of the entered dumper truck 300 (more precisely, the position of the vessel 310) as the end position.

Figure 9:
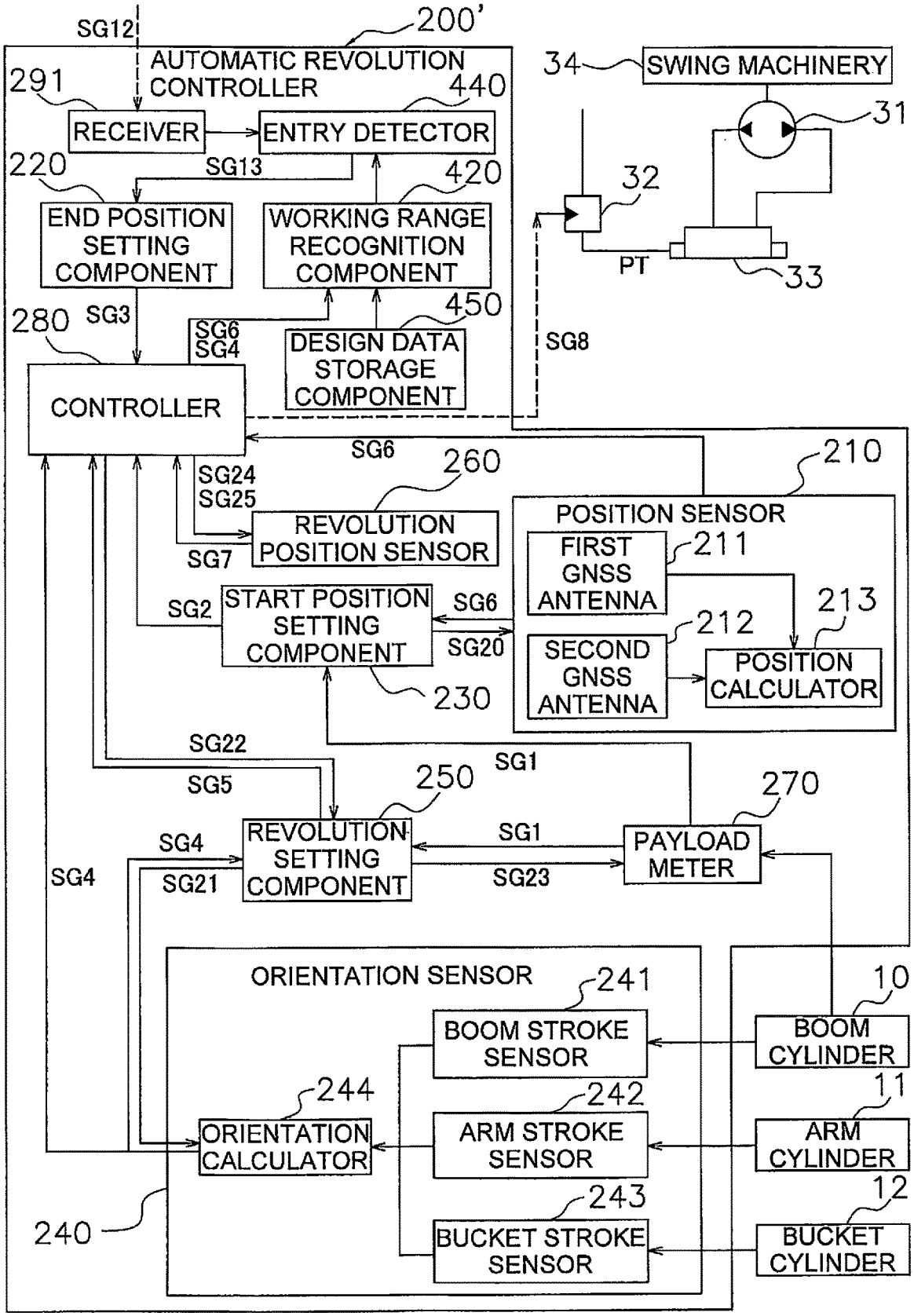
FIG. 9 is a block diagram of the configuration of an automatic revolution controller installed in a hydraulic excavator in a modification example of an embodiment of the present invention.

With the automatic revolution control device 200' shown in FIG. 9, an example of the information related to the position of the object that is the target of revolution of the revolving unit corresponds to the dumper truck information signal SG12.

(E)

In the above embodiment, the position of the revolving unit 3 and the azimuth of the revolving unit 3 when the load weight of the excavation bucket 9 has reached a specific value are set as the start position, but the position of the revolving unit 3 and the azimuth of the revolving unit 3 when the fill ratio of the excavation bucket 9 has reached a specific value may instead be set as the starting position.

Also, the fill ratio may be determined not by the payload meter 270 but by image detection or the like.

(F)

In the above embodiment, the position of the revolving unit 3 and the azimuth of the revolving unit 3 when the load weight of the excavation bucket 9 has reached a specific value are set as the start position, but the start position may instead be set by input operation by the operator.

(G)

In the above embodiment, the first receiver 410 and the second receiver 430 are described as being separate to make the description easier to understand, but a single receiver may be used instead.

(H)

In the above embodiment, the setting of the speed and acceleration during revolution in step S140 is performed after determining in step S130 whether or not revolution is possible, but this is not the only option. The setting of the speed and acceleration during revolution may be performed after determining in step S120 whether or not there is an end position, for example. Also, in the above embodiment, both acceleration and speed are set, but just one of them may be set.

(I)

In the above embodiment, the end position PE is set to be a position included in the dumper truck 300 (an object that is the target of revolution) (more precisely, the position of the vessel 310), but this is not the only option. For example, the end position of revolution may be set slightly ahead of the dumper truck 300 that is to be revolved, and here again it is possible to reduce the burden on operator operation related to a revolution operation.

(J)

In the above embodiment, the work management system 400 transmits position information about the dumper truck 300 that is the dumping object to the hydraulic excavator 100, and the hydraulic excavator 100 sets the revolution speed, etc., and performs automatic revolution on the basis of this position information, but the information transmitted to the hydraulic excavator 100 by the work management system 400 is not limited to information related to a position.

For example, the work management system 400 may create a drive instruction for the EPC valve 32 and transmit a drive instruction signal from the transmitter 460 to the receiver 291 of the hydraulic excavator 100. In this case, the work management system 400 has the end position setting component 220, and sets the revolution end position PE of the hydraulic excavator 100 from the position of a dumper truck 300 that has entered the working range R. The work management system 400 acquires excavator information, information related to the start position, orientation information, revolution position information, and the like from the hydraulic excavator 100, and creates a drive instruction for the EPC valve 32 on the basis of the acquired information and the end position PE. This drive instruction is transmitted from the work management system 400 to the hydraulic excavator 100, and upon receiving the drive instruction, the hydraulic excavator 100 controls the EPC valve 32 on the basis of this drive instruction signal to perform automatic revolution of the revolving unit 3.

Thus, a drive instruction may be transmitted from the work management system 400 to drive the hydraulic excavator 100.

In addition to the end position setting component 220, some or all of the orientation calculator 244, the revolution setting component 250, the start position setting component 230, and the position calculator 213 may be provided to the work management system 400. In this case, some or all of the values sensed by the stroke sensors 241, 242, and 243, the value sensed by the payload meter 270, and the values sensed by the first GNSS antenna 211 and the second GNSS antenna 212 are transmitted from the hydraulic excavator 100 to the work management system 400, according to the components provided in the work management system 400.

The work vehicle, work management system, and work vehicle control method pertaining to the present invention have the effect of allowing control to be performed more quickly, and can be widely applied to various kinds of work vehicle such as a hydraulic excavator.

The invention claimed is:

1. A work vehicle comprising:

a traveling unit;

a revolving unit disposed on an upper side of the traveling unit;

a work implement disposed on the revolving unit;

a swing motor operatively arranged to revolve the revolving unit;

an orientation sensor configured to sense an orientation of the work implement;

a position sensor configured to detect position information regarding the revolving unit and azimuth information regarding the revolving unit;

a transmitter that transmits the orientation of the work implement, the position information regarding the revolving unit, and the azimuth information regarding the revolving unit to a work management system that includes a work range recognition component and an entry detector, the work range recognition component recognizing a working range of the work vehicle based on design data stored in the work management system, the orientation of the work implement, the position information regarding the revolving unit, and the azimuth information of the revolving unit and the entry detector detecting an entry of a dumper truck into the working range based on information related to a position of the dumper truck; and a receiver configured to receive the information related to the position of the dumper truck from the work management system when the work management system detects the entry of the dumper truck into the working range;

an end position setting component configured to set an end position of a revolution of the revolving unit based on the information related to the position of the dumper truck when the work management system detecting the entry of the dumper truck into the working range;

a revolution position sensor configured to sense a revolution position of the revolving unit during a revolution;

a drive controller configured to control the swing motor based on the revolution position to revolve the revolving unit from a start position of a revolution to the end position; and a revolution setting component configured to set a speed and an acceleration at which the revolving unit revolves during revolution, the information related to the position of the dumper truck including information related to a tilt state of a vessel of the dumper truck.

2. The work vehicle according to claim 1, wherein the end position is a position aligned with the dumper truck.

3. The work vehicle according to claim 1, further comprising:

a load sensor configured to sense a load weight or fill ratio of a bucket of the work implement, the revolution setting component setting the speed and the acceleration based on the orientation and the load weight.

4. The work vehicle according to claim 1, further comprising:

a load sensor configured to sense a load weight or fill ratio of a bucket of the work implement; and a start position setting component configured to set a position of the revolving unit when the load weight or the fill ratio has reached a specific value, as the start position.

5. A work management system for a work vehicle including a traveling unit, a revolving unit disposed on an upper side of the traveling unit, and a work implement disposed on the revolving unit, the work management system comprising:

a first receiver configured to receive an orientation of the work implement, position information regarding the revolving unit, and azimuth information regarding the revolving unit that are transmitted from the work vehicle;

a second receiver configured to receive information related to a position of a dumper truck;

a work range recognition component configured to recognize a working range of the work vehicle based on design data stored in the work management system, the orientation of the work implement, the position information regarding the revolving unit, and the azimuth information of the revolving unit;

an entry detector configured to detect an entry of the dumper truck into the working range based on the information related to the position of the dumper truck;

an end position setting component configured to set an end position of a revolution of the revolving unit based on the information related to the position of the dumper truck when the entry detector detects the entry of the dumper truck into the working range;

a revolution setting component configured to set a speed and an acceleration at which the revolving unit revolves during the revolution; and a transmitter configured to transmit an instruction and the information related to the position of the dumper truck to a drive controller of the work vehicle, the instruction instructing the work vehicle to revolve the revolving unit from a start position of the revolution to the end position, the work management system receiving revolution position information from the work vehicle and creating the instruction based on the revolution position information and the end position, the revolution position information indicating a revolution-direction position of the revolving unit during the revolution, and the information related to the position of the dumper truck including information related to a tilt state of a vessel of the dumper truck.

6. A control method for a work vehicle including a traveling unit, a revolving unit disposed on an upper side of the traveling unit, and a work implement disposed on the revolving unit, the control method comprising:

detecting an orientation of the work implement;

detecting position information regarding the revolving unit and azimuth information regarding the revolving unit;

recognizing a working range of the work vehicle based on design data stored in a work management system, the orientation of the work implement, the position information regarding the revolving unit, and the azimuth information of the revolving unit;

detecting an entry of a dumper truck into the working range based on information related to the position of the dumper truck;

setting an end position of a revolution of the revolving unit based on the information related to the position of the dumper truck upon detecting the entry of the dumper truck into the working range;

setting a speed and an acceleration at which the revolving unit is to revolve during the revolution; and revolving the revolving unit from a start position of a revolution to the end position while sensing a revolution position of the revolving unit during the revolution, the information related to the position of the dumper truck including information related to a tilt state of a vessel of the dumper truck.

* * * * *